United States Patent [19]

Yoshihara

[11] Patent Number: 4,781,123

[45] Date of Patent: Nov. 1, 1988

[54] CONSTRUCTION OF ARTICULATING PORTION OF ARTICULATED RAILWAY CARS OR THE LIKE

[75] Inventor: Muneaki Yoshihara, Osaka, Japan

[73] Assignee: Kinki Sharyo Kabushiki Kaisha, Higashi, Japan

[21] Appl. No.: 1,626

[22] Filed: Jan. 5, 1987

[30] Foreign Application Priority Data

Sep. 5, 1986 [JP] Japan ..... 61-210067

[51] Int. Cl.[4] ..... B61D 17/14

[52] U.S. Cl. ..... 105/8.1; 105/3; 105/458; 280/403

[58] Field of Search ..... 105/8.1, 15, 16, 17, 105/18, 19, 3, 458; 280/403, 467

[56] References Cited

U.S. PATENT DOCUMENTS 3,922,971 12/1975 Maroshick ..... 105/17 X

FOREIGN PATENT DOCUMENTS 0206742 12/1986 European Pat. Off. ..... 105/18

*Primary Examiner*—Robert B. Reeves
*Assistant Examiner*—Scott H. Werny
*Attorney, Agent, or Firm*—Mason, Fenwick & Lawrence

[57] ABSTRACT

A construction of an articulating portion for articulated railway cars or the like formed by coupling front and rear bodies pivotably connected one after another by a truck interposed therebetween. Inside a pair of front and rear side wall panels in the articulating portion, a flexible cover consisting of an elastic plate is disposed, and an elastic sealing member provided on the longitudinal opposite edges of the flexible cover is contacted respectively with the pair of side wall panels by biasing. Under a pair of front and rear ceiling panels in the articulating portion, there is provided a ceiling cover, whose lateral opposite edges are coupled to the upper edge of the flexible cover, and the elastic sealing member provided on the longitudinal opposite edges of the ceiling cover is contacted respectively with the pair of ceiling panels by biasing.

7 Claims, 10 Drawing Sheets

CONSTRUCTION OF ARTICULATING PORTION OF ARTICULATED RAILWAY CARS OR THE LIKE

BACKGROUND OF THE INVENTION

1. Field of the Invention

The present invention relates to the construction for an articulating portion of articulated railway cars or the like, and more specifically, to the construction for the articulating portion of the articulated cars of a type formed by pivotably coupling front and rear bodies connected one after another by a truck interposed therebetween.

2. Description of the Prior Art

In general, such a conventional articulating portion of articulated cars has been constructed as shown in FIGS. 12 and 13.

That is, side wall panels c, c and d, d respectively protrude from an end wall portion of passages or openings h, h of bodies a, b connected one after another longitudinally, toward the longitudinal center portion between said bodies a, b and a cross section of a pair of front and rear side wall panels c, d are formed in a circular arc bending to the outside laterally of the body as shown in the drawing, the radii of curvature of the circular arcs being differing from each other. In the drawing, the radius of curvature of an upper side or the front body a is smaller than that of a lower side or the rear body b.

Inside these pair of side wall panels c, d, rigid side walls e are provided respectively. The rigid side walls e are held on a truck (not shown) between the bodies a,b and arranged to span the pair of side wall panels c, d. On the front and rear edges of the rigid side walls e, rubber protrusions f, f are disposed to contact the inner surface of the side wall panels c, d.

Meanwhile, on the upper portions of the side wall panels c, d, quarter-spherical ceiling panels g, g protruding from the passage openings h, h toward the longitudinal center portion between two bodies a, b are disposed in different heights. Under the ceiling panels g, g and adjacent to the underside thereof, ceiling rigid walls (not shown) extending upwardly from the upper edges of the rigid side walls e, e are disposed.

However, in such a construction, the following disadvantages have occurred.

That is, when the articulated cars approach the track which is curved within the vertical plane, a positional relationship between the side wall panels c, d—and the ceiling panels g, g changes considerably in a vertical direction, resulting in such a disorder as damaging the rubber protrusions f, f and causing various problems.

Referring to FIGS. 12 and 13, these problems will be explained as follows:

FIG. 12 shows a transverse sectional view of the upper portion of articulating portion when the articulated cars are on the track which is curved within the level (within the plane parallel to the drawing), and sunk within the vertical plane (within the plane normal to the drawing).

In this case, the circular arc centers 01, 02 of a pair of front and rear side wall panels c, d are shifted outside (leftside in FIG. 12) of the curve within the level of the track, from the point of intersection of lateral center lines 1, m of the bodies a, b, or the truck center 0. Therefore, a tip portion i of the side wall panel c located inside the curve is just about the contact a bent portion or radius starting portion j of the corresponding side wall panel d as shown in the drawing. Also, a front rubber protrusion f1 of the rigid wall e inside the curve is pressed and bent strongly by the inner surface of a bent portion or radius starting portion k of the side wall panel c, and biased in an excessively compressed state. The biased state of these rubber protrusions f—is, in FIG. 12, gradually eased in order from the right lower side f2 to left upper side f3 and left lower side f4, but still, if such biased state is repeated as time elapses, the rubber protrusions f—will be damaged gradually.

On the other hand, FIG. 13 shows a transverse sectional view of the upper portion of articulated portion, when the articulated cars are on the track which is curved within the level and raised within the vertical plane.

In this case, circular arc centers 01, 02 of the pair of side wall panels c, d are, contrary to the case of FIG. 12, shifted inside the curve (right side in FIG. 13) within the level of the track from the truck center 0. Therefore, the rubber protrusions f1, f2 of the rigid side wall e inside the curve are isolated from the inner surface of the side wall panels c, d and form a large gap therebetween as shown in the drawing.

Meanwhile, the rubber protrusions f3, f4 outside the curve also fail to maintain a proper biased state against the inner surface of the side wall panels c, d, whereby the tips of rubber protrusions f3, f4 are easily turned over and gaps are formed therebetween.

Where the track rises or descends vertically, the variation in width of a gap between the side wall panels c, d is larger at the top and smaller at the bottom.

Furthermore, when the articulated cars are on the track sinking within the vertical plane, the gap between the ceiling panes g, g and edges of the ceiling rigid wall thereunder is larger than that on the usual flat track. On the other hand, when the articulated lorries are on the track rising within the vertical plane, the gap between the ceiling panels g, g and the ceiling rigid wall conversely becomes smaller than usual in a nearly contacting state.

On the track sinking or rising within the vertical plane as such, the gap between the rubber protrusions f—and the side wall panels c, d, or between the ceiling rigid wall and the ceiling g, g becomes larger or smaller and the two respective members draw abnormally away or near with respect to each other, thereby causing such various problems as, (1) deteriorating appearance, (2) occurrence of such trouble as catching a passenger's fingers and other objects in the gap, (3) accumulating dusts inside the articulated structure from the gap, and (4) catching a car fire by a lit cigarette and match or the like thrown in by vandalism.

BRIEF SUMMARY OF THE INVENTION

The present invention is directed to such conventional problems; therefore, it is a primary object of the present invention to provide a novel construction of an articulating portion for articulated railway cars which is able to solve the aforementioned problems.

It is another object of the present invention to provide a construction of an articulating portion for articulated lorries which is able to prevent such trouble as catching pasenger's fingers and other objects between each component member of the articulating portion, and to prevent a lit cigarette and match or the like from being thrown in from these gaps by vandalism because these gaps are exposed to passengers.

It is a further object of the present invention to provide a construction of an articulating protion for articulated cars which is able to prevent dusts from being accumulated inside the articulating portion, and to obstruct the internal view of the articulating portion to maintain a good appearance.

It is an additional object of the present invention to provide a construction of an articulating portion for articulated cars in which gaps in the articulating portion of the articulated lorries are not formed, even when the articulated lorries approach the track which is curved horizontally or vertically or in both directions simultaneously.

It is still another object of the present invention to provide a construction of an articulating portion for articulated cars in which, on the curved track, gaps are not formed between a pair of front and rear side wall panels and elastic sealing members provided on both edges of flexible covers, between a pair of front and rear ceiling panels and elastic sealing members provided on longitudinal opposite edges of ceiling covers, and between both lateral edges of the ceiling covers and upper edges of the flexible covers.

It is a further object of the present invention to provide a construction of an articulating portion for articulated cars in which, in the articulating portion for the articulated cars formed by pivotably coupling serial front and rear bodies by a truck interposed therebetween, flexible covers comprising elastic plates are provided inside a pair of front and rear side wall panels, ceiling covers are provided under a pair of front and rear ceiling panels while elastic sealing members arranged on both longitudinal edges of the flexible covers are respectively biased and contacted with the pair of side wall panels, both lateral edges of said ceiling covers being connected to the upper edges of flexible covers, and the elastic sealing members provided on both longitudinal edges of said ceiling covers are respectively biased and contacted with the pair of ceiling panels.

The above and other related objects and features of the present invention will be apparent from a reading of the detailed description of the disclosure found in the accompanying drawings and the novelty thereof pointed out in the appended claims.

DETAILED DESCRIPTION OF THE PREFERRED EMBODIMENTS

FIG. 1 through FIG. 11 of the accompanying drawings shown a construction of an articulating portion for articulated cars of one embodiment in accordance with the present invention.

Figure 1:
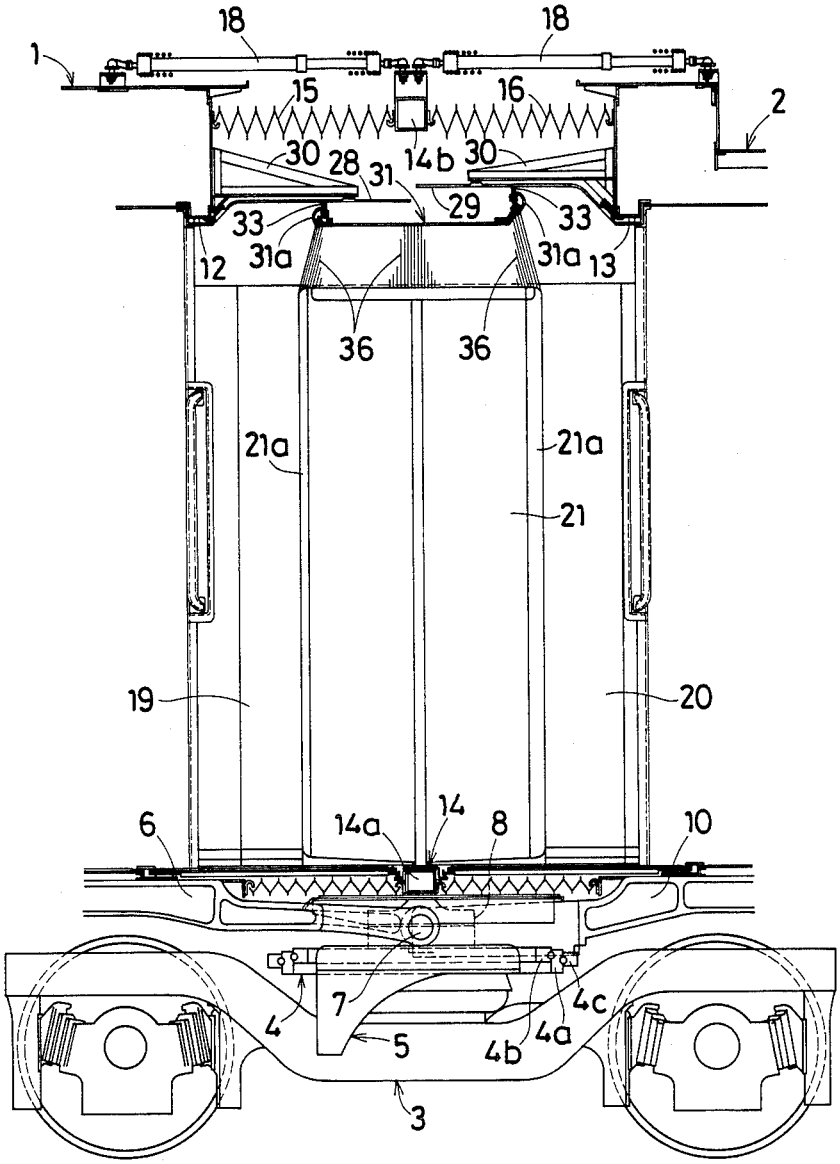
FIG. 1 is a side longitudinal sectional view showing one embodiment of a construction of an articulating portion for articulated cars in accordance with the present invention.
Figure 3:
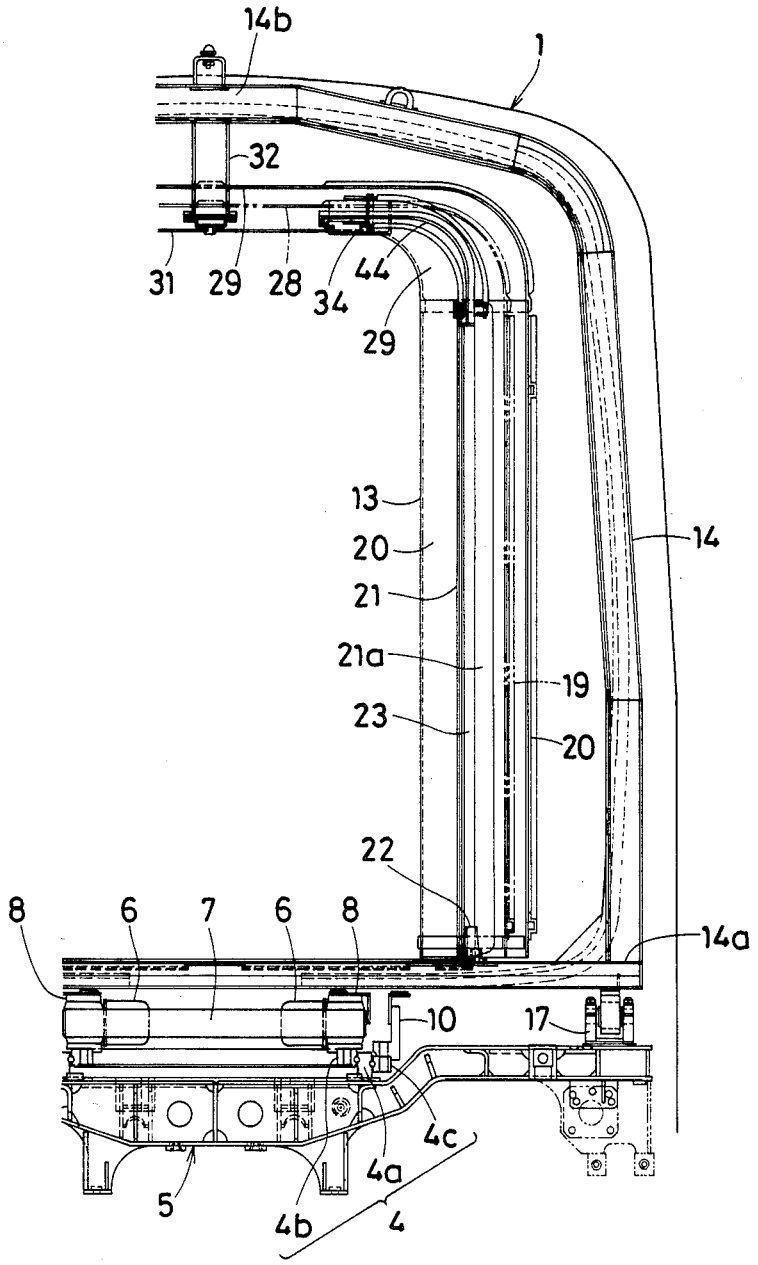
FIG. 3 is a front longitudinal sectional view showing a part of the same construction.
Figure 4:
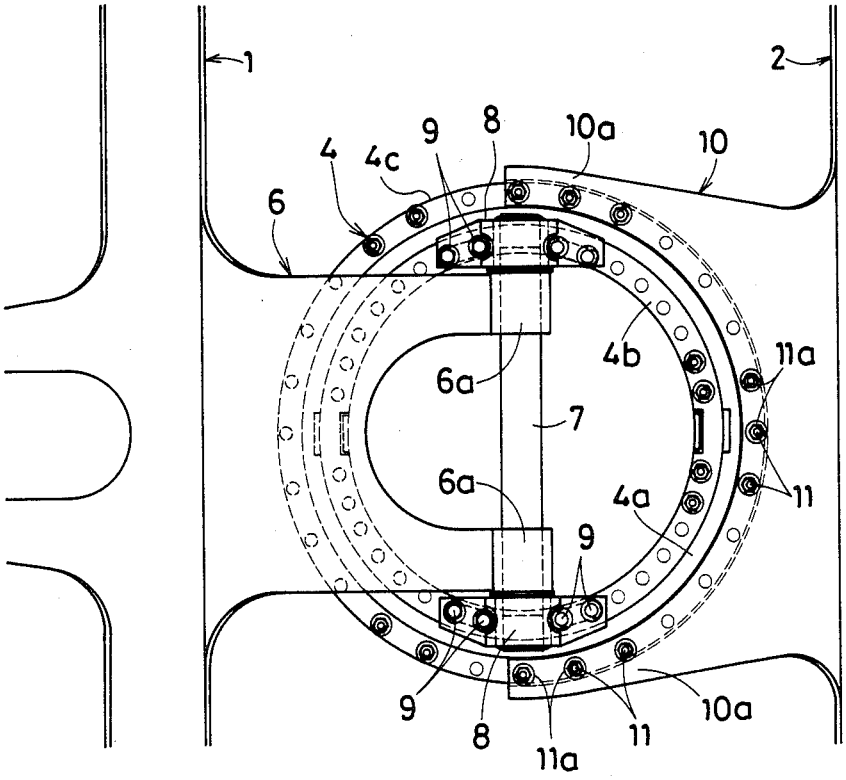
FIG. 4 is a plan view showing another part of the same construction.

In FIG. 1, bodies 1, 2 are longitudinally serial and coupled with a truck 3, which is arranged to span the two bodies 1, 2 thereunder. On the upper center portion of the truck 3, a so-called truck bolster device 5 is provided and a ball bearing 4 having a large diameter is disposed thereabove. The ball bearing 4 comprises three rings 4*a*, 4*b*, 4*c*, of which an intermediate ring 4*a* is mounted to the truck bolster device 5 as shown in FIG. 3, Under one body or the front body 1, a coupling member 6 is provided to protrude above an inner ring 4*b* of the ball bearing 4. The tip portions 6*a*,6*a* of the coupling member 6 are in a flat U-shaped form as shown in FIG. 4. A pin 7 which is inserted through the tip portions 6*a*, 6*a* passes through the center of ball bearing 4, and is mounted on the inner ring 4*b* of the ball bearing 4 at its opposite ends by plain bearings 8,8. Rubber bushings are respectively provided between the pin 7 and each of plain bearings 8, 8 so as to slightly restrict the pivoting of the in 7 in a vertical direction. Thereby the coupling member 6 may be swingable vertically about the pin 7 relative to the ball bearing 4. The numeral 9 indicates bolts for mounting the plain bearings 8.

On the other hand, under the other body or the rear body 2, a coupling member 10 is secured to protrude above an outer ring 4*c* of the ball bearing 4. The tip portions 10*a*,10*a* of the coupling member 10 are substantially in a U-shaped form as shown in FIG. 4. The tip portions 10*a*, 10*a* are mounted on the outer ring 4*c* by means of a plurality of bolts 11 and nuts 11*a*.

Above the center portion of the ball bearing 4 and in a lateral direction of the truck 3, there is provided a center retaining frame 14, which includes an opening area larger than the passage openings 12, 13 of the two bodies 1, 2. On the front and rear sides of the center retaining frame 14, bellows 15, 16 are provided respectively and coupled to the side of center retaining frame 14 at one end, and to the bodies 1, 2 at the other end as shown in FIGS. 1 and 2.

A bottom frame 14*a* of the center retaining frame 14 passes above te plain bearing 8 and is pivotably supported by receiving members 17 mounted to the truck bolster device 5 at its both ends as shown in FIG. 3. Thereby the center retaining frame 14 is inclinable about the bottom frame 14*a* in a longitudinal direction. On the other hand, the upper center portion of a top frame 14*b* of the center retaining frame 14 is coupled to the bodies 1, 2 by equalizer springs, 18, 18 including shock absorbing means.

On both sides of each of the passage openings 12, 13, side wall panels 19, 20 are provided to protrude toward the longitudinal center of the truck 3. Sectional plans of the side wall panels 19, 20 are, as shown in FIG. 2, bent outwardly laterally in a circular arc shape, radii of curvature of which are set to differ from each other. The pair of front and rear side wall panels 19, 20 are mounted so as to make the circular arc-shaped section concentrical and to form the side wall of the articulating portion. Inside both the two sets of side wall panels 19, 20,—flexible covers 21 are installed respectively. The flexible cover 21 is made of such a sheet material as stainless steel, and mounted with its longitudinal center portion being biased to deform outwardly laterally as shown in FIG. 2. That is, a sectional plan of the flexible cover 21 is, as shown by a double dotted chain line in FIG. 2, formed to bend toward the lateral center side of the truck 3, and in mounting, its longitudinal center portion is biased to deform outwardly laterally as shown by a full line. A deformation value of biasing is set at about 100 mm. The lower portion of the flexible cover 21 is, as shown in FIG. 3, mounted to a receiving metal 22 secured to the bottom frame 14*a* of the center retaining frame 14. Since the flexible cover 21 is coupled to a ceiling cover 31 (to be described later) at its upper edge, on the outer surface side of the longitudinal center portion, a channel-shaped mounting member 23 for the flexible cover 21 extending vertically is secured.

Figure 2:
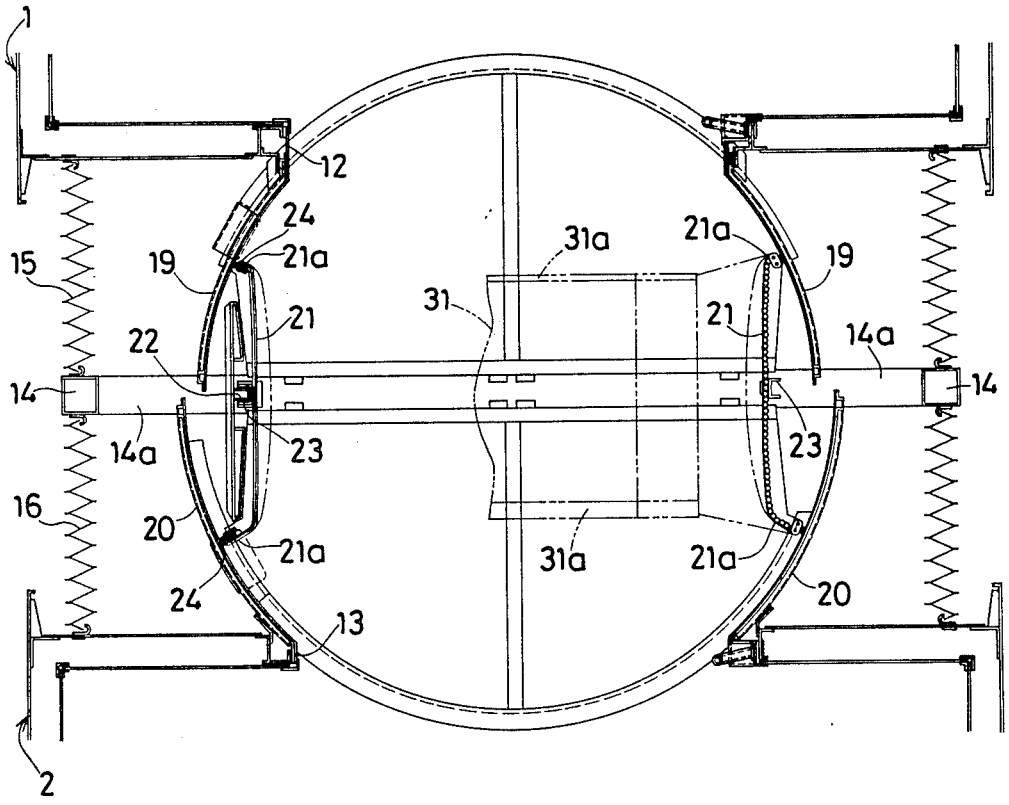
FIG. 2 is a transverse sectional view showing a construction of an articulating portion for articulated cars, but respectively cut away at the intermediate portion of a flexible cover in the left half portion, and at the upper surface of a horizontal retaining member of the flexible cover in the right half portion.
Figure 5:
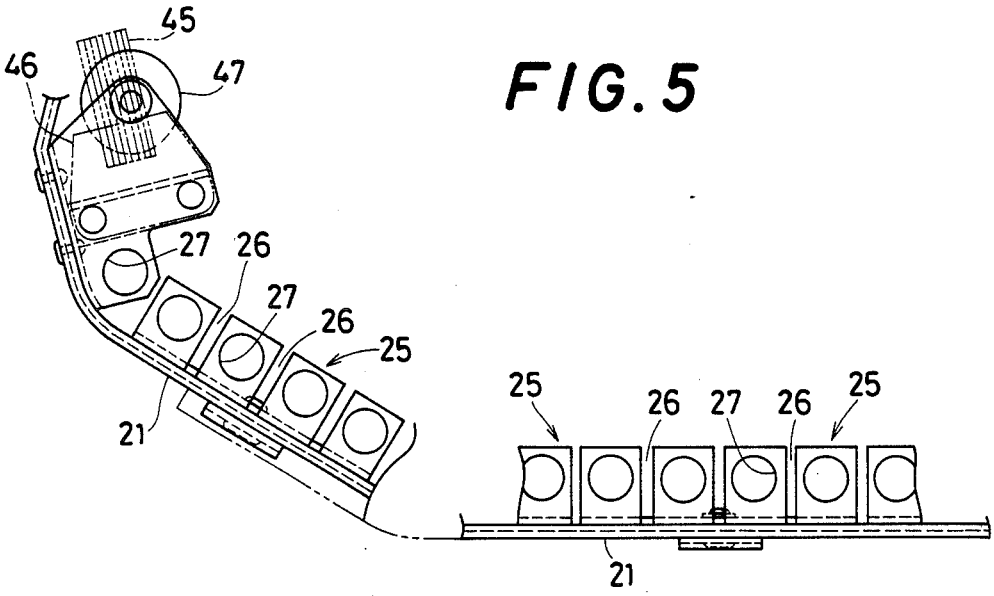
FIG. 5 is a plan view showing a part of a horizontal retaining member mounted on a flexible cover of the same construction.

On both longitudinal ends of the flexible covers 21, as shown in FIG. 2, bent portions 21*a*,21*a* having different lengths are formed respectively facing the inner surface of the side wall panels 19, 20. On tips of the bent portions 21*a*,21*a*, elastic brushes 24 made of such a material as nylon are mounted respectively, which are biased to contact the inner surface of the side wall panels 19, 20 by the elastic force of the flexible cover 21. On the upper outer surface of the flexible cover 21, as shown in FIG. 5, a plurality of channel-shaped horizontal retaining members 25 having a suitable length are mounted in parallel in the horizontal direction. On the upper and lower horizontal portions of the horizontal retaining members 25, rifts 26—are provided with a predetermined distance, so as not to prevent elastic deformation of the flexible cover 21. On the upper and lower surfaces of the horizontal retaining members 25, holes 27 are formed respectively in horizontal portions divided by the rifts 26--. The number of holes 27 is not limited to one. The numeral 47 represents a roller provided for safety operation when abnormal, within the channel at opposite ends of the horizontal retaining member 25.

Figure 6:
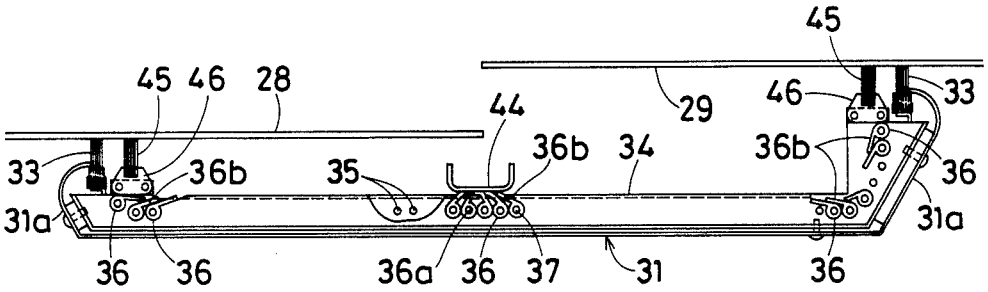
FIG. 6 is a side view showing a ceiling cover and a receiving member of the same construction.

Above the side wall panel 19, 20 in each passage openings 12, 13 of the bodies 1, 2, as shown in FIG. 1, a pair of front and rear ceiling panels 28, 29 are disposed respectively in different heights, thereby forming a ceiling wall of the articulating portion. The upper side portion of ceiling panels 28, 29 is respectively retained by supporting arms 30, 30 fixed to the bodies 1, 2. Immediately under the ceiling panels 28, 29, a ceiling cover 31 is provided. A lateral length of the ceiling cover 31 is set shorter than the distance between both flexible covers 21, 21, and the center portion of ceiling cover 31 is held by an arm 32 mounted to an upper frame 14*b* of the center retaining frame 14. On the longitudinal opposite ends of the ceiling cover 31, as shown in FIG. 6, inclined bent portions 31*a*, 31*a* having different lengths are disposed respectively. The two inclined bent portions 31*a*, 31*a* are formed upwardly with elastic brushes 33 being mounted on the tip portions thereof. The elastic brushes 33 are biased against the underside of the ceiling panels 28, 29 for contact and are arranged to eliminate any gap therebetween.

Figure 7:
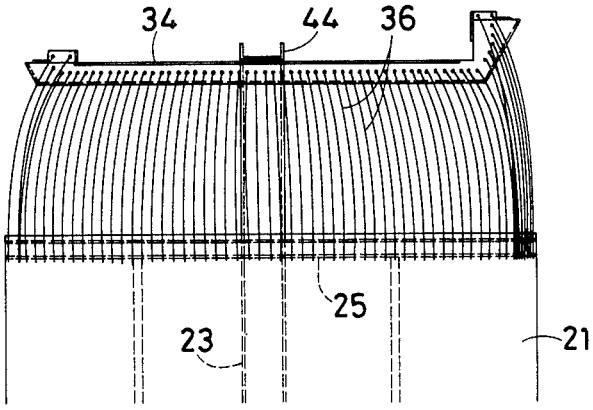
FIG. 7 is a side view typically showing a configuration of a number of elastic wire members constituting an elastic sealing means of the same construction.

On the lateral opposite ends on the upper side of ceiling cover 31, a receiving member 34 as shown in FIG. 6 is arranged throughout the longitudinal direction of the ceiling cover 31. In the receiving member 34, the same number of holes 35—as the holes 27 are formed. The holes 35 are formed at a predetermined pitch in response to the holes 27—provided in the horizontal retaining member 25 of the flexible cover 21. Between the horizontal retaining member 25 and the receiving member 34, as shown in FIGS. 6 and 7, elastic smoothly bent hollow tubes 36—with a number of fins are arranged close to one another. The elastic hollow tubes 36—are held on the horizontal retaining member 25 and the receiving member 34 by an elastic axes 37 inserted through the holes 36*a*. As the elastic hollow tube 36, such a material as rubber is used and as the elastic axis 37, such a material as stainless steel is used.

Figure 8:
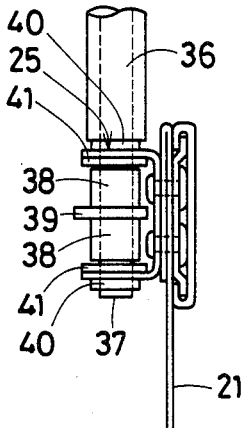
FIG. 8 is a front view showing a mount of the lower end of said elastic wire member and a flexible cover.

The lower end of the elastic axis 37 is mounted to the horizontal retaining member 25 as shown in FIG. 8. That is, the lower end of the elastic axis 37 is inserted through two spacers 38, 38 inserted into the channel of the horizontal retaining member 25, and held by a U-shaped retaining ring 39 between the spacers 38, 38, whereby it is prevented from slipping out of the horizontal retaining member 25. Numerals 40, 41 respectively designate resin abrasion plates inserted into the outer and inner surface sides of the horizontal retaining member 25.

Figure 9:
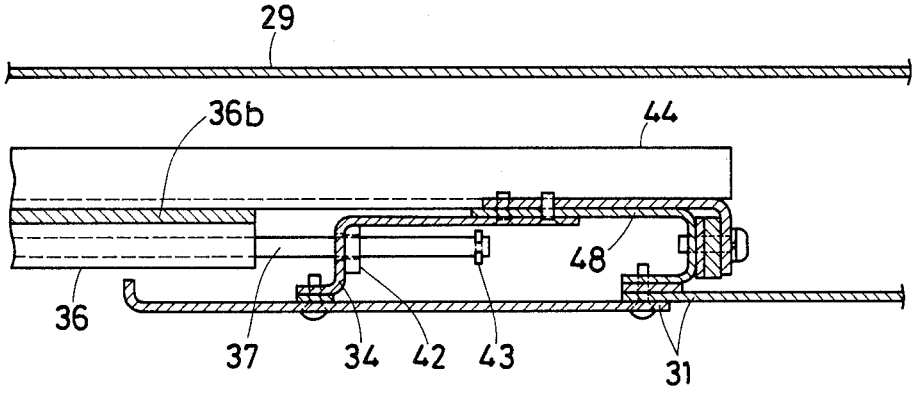
FIG. 9 is a front longitudinal sectional view showing a mount of the upper end of said elastic wire member and a ceiling cover.

Meanwhile, the upper end of the elastic axis 37 is mounted to the receiving member 34 as shown in FIG. 9. That is, the upper end of the elastic axis 37 is inserted through each hole in the receiving member 34 and the abrasion plate 42 made of resin and mounted to the inner surface of said receiving member 34, and at one position on the elastic axis 37 projecting by a predetermined length from the abrasion plate 42, an E-shaped retaining ring 43 is fixed, whereby it is prevent form slipping out of the receiving member 34. In this case, also on the opposite side of the projecting side of the receiving member 34, the elastic axis 37 is exposed by a predetermined length.

Thus, the elastic hollow tube 36 may be effectively responsive to a certain displacement in a longitudinal direction, due to its own elastic compressibility and the slidable construction by the elastic axis 37. The amount of displacement is set at about plus or minus 50 mm or 50 mm each from the receiving member 34;

A fin 36*b* of the elastic hollow tube 36 is provided throughout the longitudinal direction of the elastic hollow tube 36. The fin 36*b* is, as shown in FIG. 6, formed to extend in a tangential direction of the circular section of the elastic hollow tube 36, and its tip is suitably bent corresponding to the location where it is arranged. The elastic hollow tubes 36—are arranged in such a manner that the fins 36*b* respectively contact the surface of the adjacent elastic hollow tubes 36.

Among a series of elastic hollow tubes 36—, the elastic hollow tubes 36—arranged in the longitudinal center portion are in contact with the underside of a coupling member 44. The coupling member 44 is formed by the aforementioned mounting member 23 rising along the outer surface of the flexible cover 21 and, as shown in FIG. 9, fixed to a receiving metal 48 of the ceiling cover 31. The receiving metal 48 is also coupled to the receiving member 34, and fixed to the upper frame 14*b* of the center retaining frame 14 at the longitudinal center of the ceiling cover 31 via the mounting arm 32.

Meanwhile, in FIG. 6, between the elastic hollow tubes 36, 36 arranged on the longitudinal opposite ends (right and left direction in the drawings) and each ceiling panel 28, 29, rubber retaining members 46, 46 with elastic brushes 45, 45 planted therein are disposed respectively, thereby clossing the gap therebetween. The opposite ends of rubber retaining member 46 are mounted respectively to the horizontal retaining member 25 of the flexible cover 21 and the receiving member 34 of the ceiling cover 31. (refer to FIGS. 5 and 6)

Now, in the articulating portion for the articulated railway cars constructed as above, when the articulated lorries 1, 2 pass or negotiate the track which is curved horizontally or vertically or in both directions simultaneously, and even when the positional relationship between each pair of side wall panels (side walls) 19, 20 and the flexible cover 21 inside thereof has changed, the flexible cover 21 elastically deforms in itself to effectively follow the movement of each of the side wall panels 19, 20, since the longitudinal center portion is, as previously described, biased to deform elastically outwardly laterally or to the inner surface side of the side walls 19, 20.

Figure 10:
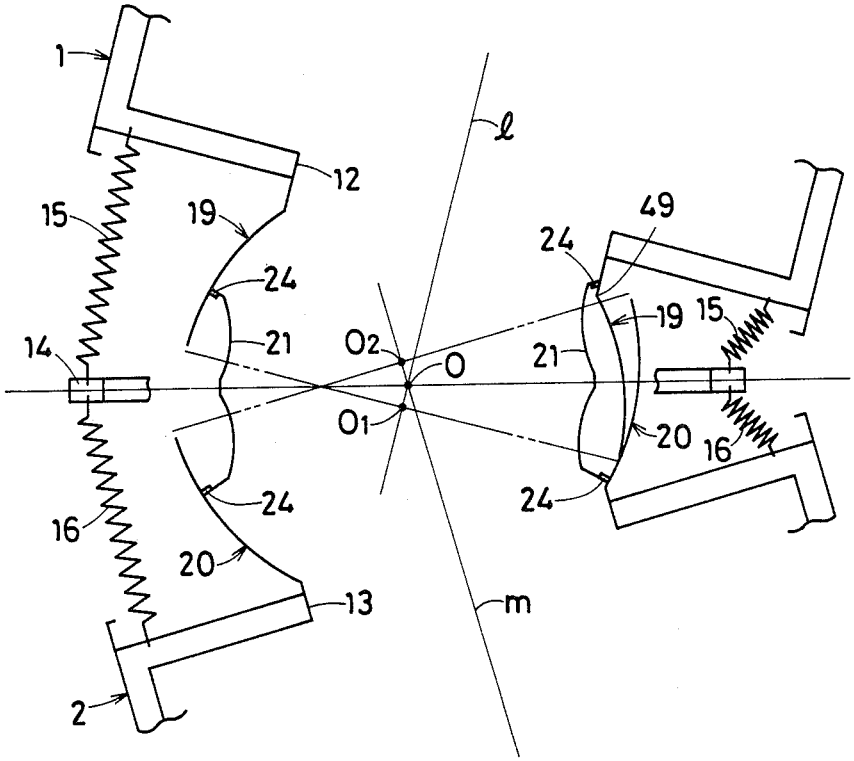
FIG. 10 is a transverse sectional view schematically showing a state of construction of an articulating portion for articulated cars, when it is passing or negotiating the track which is sunk within the vertical plane and curved rightwards within the level.
Figure 11:
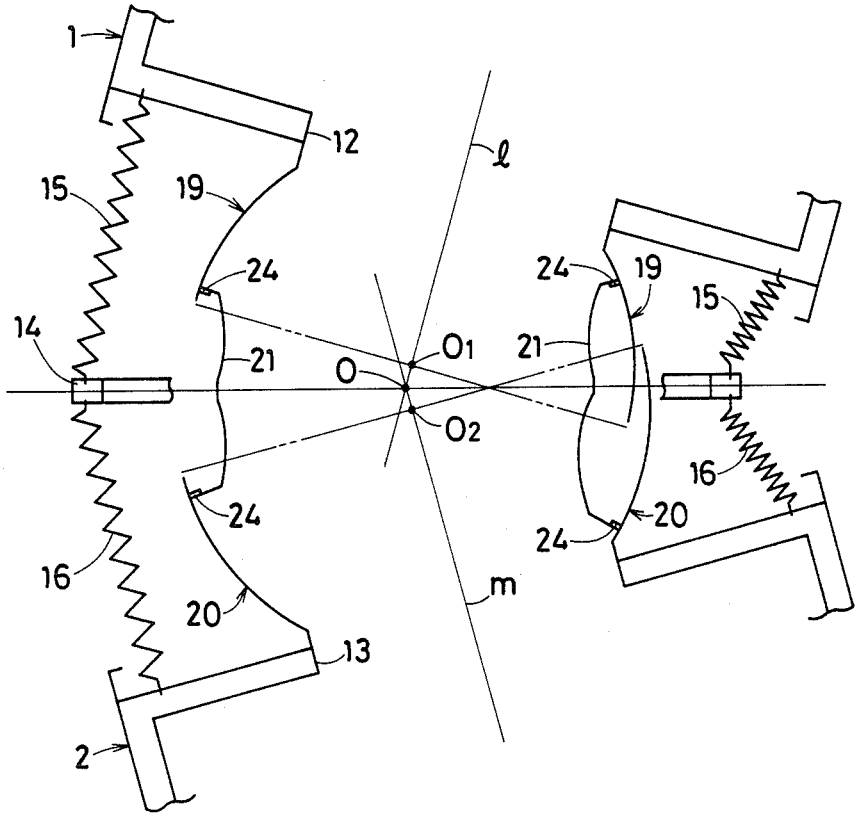
FIG. 11 is a transverse sectional view schematically showing a state of construction of an articulating portion for articulated cars, when it is passing or negotiating the track which is raised within the vertical plane and curved rightwards within the level.

Referring to FIGS. 10 and 11, these operations will be explained in detail.

Figure 12:
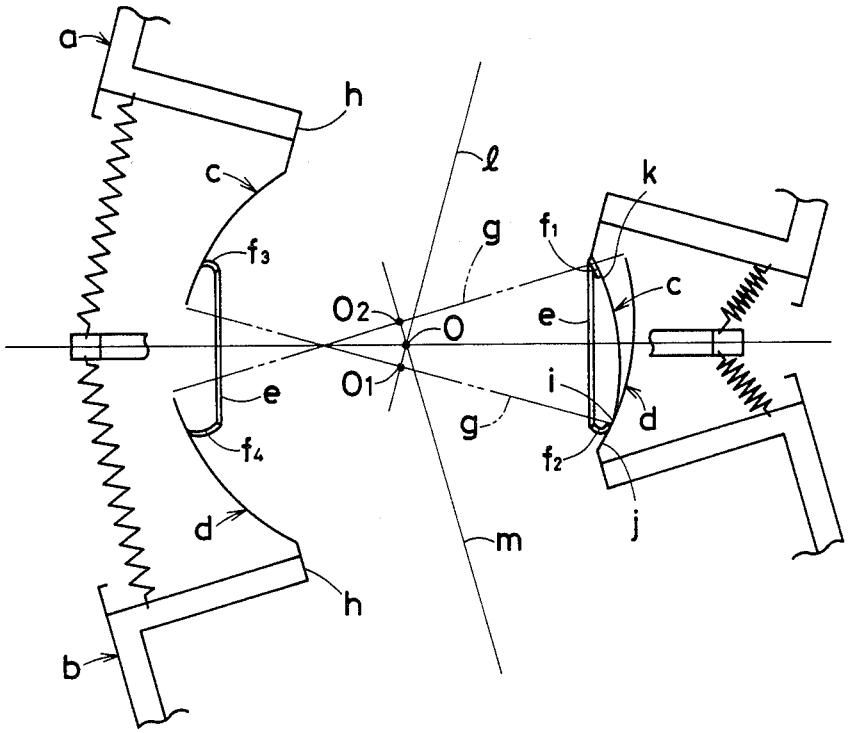
FIG. 12 PRIOR ART
FIG. 12 is a transverse sectional view corresponding to FIG. 10 and showing a conventional construction of an articulating portion for articulated lorries.
Figure 13:
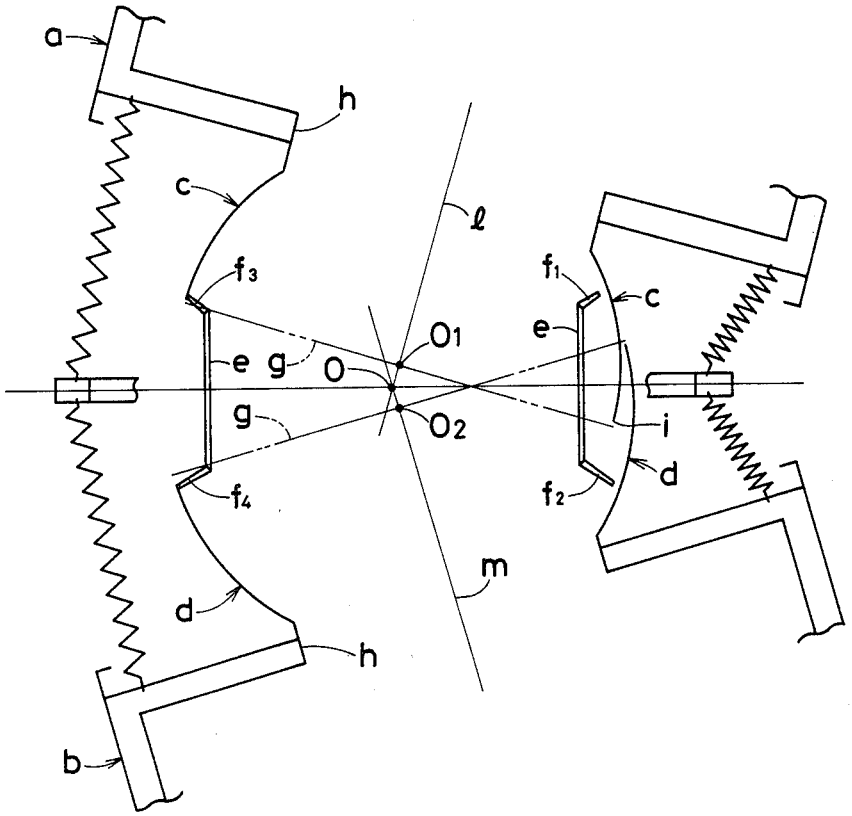
FIG. 13 PRIOR ART
FIG. 13 is a transverse sectional view corresponding to FIG. 11 and showing a convention construction of an articulating portion for articulated cars.

FIGS. 10 and 11 respectively show the state of the articulating portion of the front and rear bodies 1, 2, when the articulated cars 1, 2 approach the track having curves corresponding to the conventional example in FIGS. 12 and 13. That is, FIG. 10 shows a transverse sectional view of the upper articulating portion, when the bodies 1, 2 are on the track which is curved within the level (within the plane parallel to the drawing) and sunk within the vertical plane (within the plane vertical to the drawing).

On the other hand, FIG. 11 shows a transverse sectional view of the upper articulating portion, when the bodies 1, 2 are on the track which is curved within the level and raised within the vertical plane.

Meanwhile, the state of the bent portion of the flexible cover 21 in FIGS. 10 and 11 is shown rather exaggeratedly for purposes of illustration.

It will be clearly understood from these drawings that the biased state of the elastic brushes 24, 24 on one of the opposite ends of each flexible cover 21 against each side wall panels 19, 20 has been improved on the prior art. That is, the contact of each elastic brush 24, 24 mounted to the flexible cover 21 with the inner surface of each of the side wall panels 19, 20, is always maintained with a moderate biasing force in either of the states shown in FIG. 10 and FIG. 11. In particular, the upper right elastic brush 24 in FIG. 10 still maintains a moderate biased state against the side wall panel 19, even after passing over a bent portion 49 of the side wall panel 19 bent toward the passage opening 12.

Although gaps between a plurality of elastic hollow tubes 36, 36—held by the horizontal retaining member 25 change slightly when the flexible cover 21 changes elastically, it will not cause gaps between each of the elastic hollow tubes 36, 36—, since the fin 36*b* of each of the elastic hollow tube 36 is moved while contacting the surface of the adjacent elastic hollow tube 36.

Furthermore, gaps between the elastic hollow tubes 36, 36 on the opposite ends of the flexible cover 21 and the ceiling panels 28, 29, are also eliminated by the elasticity of the rubber retaining member 46 planted with the elastic brush 45.

In addition, as the flexible cover 21 deforms elastically, the distance between the horizontal retaining member 25 and the receiving member 34 of the ceiling cover 31 is changed. The reduction of the distance in this case is absorbed by the movement of the exposed portion of the elastic axis 37 before the receiving member 34 inside the ceiling cover 31, and by the contraction due to the elastic compressive force in a longitudinal direction received by the elastic hollow tube 36. On the other hand, when the distance between the two members 25, 34 is enlarged, it is absorbed by the elastic axis 37 inserted through the receiving member 34, which is drawn out to the position where it is retained on the receiving member 34 by the E-shaped retaining ring 43.

Thus, even when the articulated cars 1, 2 pass or negotiate the track which is curved horizontally or vertically or in both directions simultaneously, gaps are not formed between the opposite ends 21*a*, 21*a* of the flexible cover 21 and the inner surface of each of the side wall panels 19, 20, between the longitudinal direction and lateral direction (lengthwise) of the elastic hollow tube 36—, between the opposite ends of the elastic hollow tube 36 and each of the ceiling panels 28, 29, and between the ceiling covers 31, 31 and the ceiling panels 28, 29 in the articulating portion of the bodies 1, 2.

The flexible cover 21, ceiling cover 31 and elastic brushes 24, 33, and 45 attached thereto have a suitable rigidity, and are sufficiently endurable to resist vandalism such as knife-cutting or the like when compared to the conventional method using only a piece of rubber.

While the embodiment described in the detailed description is for illustrative purposes only, it is to be understood that the present invention is not limited thereto or taken in a narrow sense, that various changes and modifications may be made within the scope of the appended claims and the spirit of the present invention.

As particularly described above, according to the present invention, the various following advantages may be obtained.

(1) Gaps are not formed between a pair of front and rear wide wall panels and the elastic sealing members disposed on the opposite edges of the flexible cover, between a pair of front and rear ceiling panels and the elastic sealing members on both longitudinal edges of the ceiling cover, and between both lateral edges of the ceiling cover and the upper edges of the flexible cover, even when the articulated lorries approach the track which is curved horizontally, vertically or in both the directions simultaneously.

(2) Since gaps are not formed in the articulating portion of the articulated lorries on the curved track, such trouble as catching a passenger's fingers and other objects in the gaps, or such mischief as throwing a lit cigarette and match or the like through the gaps may be prevented effectively.

(3) Since gaps in the articulating portion of the articulated lorries are not formed on the curved track, dusts is prevented effectively from accumulating in the articulating portion through the gaps, and since the internal view of the articulating portion, which was exposed through the gaps in the past, is completely obstructed, the appearance of the articulating portion is greatly improved as compared with the prior art.

What is claimed is:

1. In articulated railway cars or the like provided with a truck in the center portion between serial front and rear bodies, which are coupled pivotably horizontally and vertically around the center portion of said truck, a construction of an articulating portion for the articulated cars, in which a pair of front and rear side wall panels and a pair of ceiling panels are respectively longitudinally disposed in the center portion between said two bodies around a passage opening on the opposing side of each said body to respectively form both side walls and ceiling walls;

said pair of front and rear side wall panels have circular arc-shaped sectional plans bending outwardly laterally, radii of curvature of said circular arcs are made concentrically and to differ from each other;

said pair of ceiling panels are in different heights;

flexible covers made of elastic plates are installed inside said side walls, elastic sealing members are provided on the longitudinal opposite sides of said flexible covers and biased to contact said pair of side wall panels by the elastic force of said flexible covers; and ceiling covers are provided under said ceiling walls, the lateral opposite edges of said ceiling covers are coupled to the upper edges of said flexible covers, and elastic sealing members respectively contacting said pair of ceiling panels by biasing are provided on the longitudinal opposite edges of said ceiling covers.

2. A construction of an articulating portion for articulated cars as claimed in claim 1, wherein gaps between the upper edges of said flexible covers and the lateral opposite edges of said ceiling covers are closed by elastic sealing means comprising a plurality of elastic wire members.

3. A construction of an articulating portion for articulated cars as claimed in claim 1, wherein the longitudinal center portion of said flexible cover is elastically biased to deform outwardly laterally.

4. A construction of an articulating portion for articulated cars as claimed in claim 1, wherein flexible covers are made of elastic metal plates.

5. A construction of an articulating portion for articulated cars as claimed in claim 1, wherein said elastic sealing members are elastic brushes.

6. A construction of an articulating portion for articulated cars as claimed in claim 2, wherein the elastic wire members of said elastic sealing means comprise elastic hollow tubes including fin members and elastic rods inserted through hollow holes in said elastic hollow tubes, and the fin members of said elastic hollow tubes are provided to contact the surface of the adjacent elastic hollow tubes.

7. A construction of an articulating portion for articulated cars as claimed in claim 6, wherein each of said elastic rods is supported rotatably on the upper edge of said flexible cover at one end, and retained reciprocally on the lateral edge of said ceiling cover at the other end.

* * * * *